United States Patent [19]

Wheeler et al.

[11] Patent Number: 4,635,068

[45] Date of Patent: Jan. 6, 1987

[54] DOUBLE-TUNED DISC LOADED MONOPOLE

[75] Inventors: Harold A. Wheeler, Smithtown; Clifford H. Friedman, East Northport, both of N.Y.

[73] Assignee: Hazeltine Corporation, Commack, N.Y.

[21] Appl. No.: 741,333

[22] Filed: Jun. 5, 1985

[51] Int. Cl.[4] ..... H01Q 9/38

[52] U.S. Cl. ..... 343/749; 343/830

[58] Field of Search ..... 343/749, 773, 828–830, 343/846, 807, 899

[56] References Cited

U.S. PATENT DOCUMENTS

| | | | |
|---|---|---|---|
| 2,368,663 | 2/1945 | Kandoian | 343/773 |
| 3,656,166 | 4/1972 | Klopach | 343/773 |
| 3,852,760 | 12/1974 | Reggia | 343/830 |

*Primary Examiner*—Eli Lieberman

*Attorney, Agent, or Firm*—E. A. Onders; F. R. Agovino

[57] ABSTRACT

A monopole antenna is mounted on a ground plane and incorporates a radiating structure such as a disc or hollow cap parallel to the ground plane, for loading the antenna. An elevated feed is formed by a biconical central post between the radiating structure and the ground plane. Tuning is also accomplished by a partial or total circumferential dielectric (which may also function as a support) having an outer electrically conducting sheet spaced apart from the central post to provide shunt capacitance, and by outboard inductive posts which connect between the ground plane and the radiating structure to provide shunt inductance. Alternatively, additional tuning may be accomplished by a circuit between the upper and lower portions of the central post.

15 Claims, 9 Drawing Figures

VSWR VS. FREQ OF
DISK-LOADED MONOPULSE

INPUT IMPEDANCE
2:1 FREQ BAND

INPUT IMPEDANCE
3:1 FREQ BAND

DOUBLE-TUNED DISC LOADED MONOPOLE

The Government has rights in this invention pursuant to Contract No. DAAK80-81-C-0124.

BACKGROUND OF THE INVENTION

This invention relates to a monopole antenna and, more particularly, to a disc-loaded monopole antenna which is mounted on a ground plane and is smaller than a wavelength of operation.

A monopole antenna having dimensions smaller than a wavelength of operation is useful in situations requiring an omnidirectional radiation pattern, and fairly close impedance matching to a line over a large bandwidth. In a common form of construction, such an antenna is mounted on a ground plane which serves as an element of the antenna in establishing the radiation pattern. Particular utility of such a construction is found in situations wherein the antenna is mounted on an exterior electrically conductive surface of a vehicle such as an aircraft, for transmission and reception of electromagnetic signals, and wherein the exterior surface of the aircraft serves as the ground plane.

It is desirable, in the case of vehicular communication, to minimize the size of the antenna, to provide a uniform antenna radiation pattern, and to operate over a large bandwidth with minimum standing wave ratio (VSWR).

In general, such antennas are described in Harold A. Wheeler's article entitled "Small Antennas," IEEE Transactions on Antennas And Propagation Vol. AP-23, No. 4, pages 462–469, July, 1975.

SUMMARY OF THE INVENTION

The foregoing desirable features and other advantages are provided by a monopole antenna mounted on a ground plane. The invention simplifies the overall configuration of the antenna as well as components of the antenna structure which tune the antenna to a prescribed frequency band. In accordance with the invention, loading of the antenna is provided by a disc spaced apart from the ground plane and parallel thereto by a central post which extends between the disc and the ground plane. The post is formed with opposing conical faces. The lower portion is in contact with the ground plane and has a bore which encloses a coaxial transmission line. An inner conductor of the line is connected to the upper conical portion of the central post. Tuning of the antennas is accomplished by either of two structures. The first tuning structure comprises a capacitive strip separated from the central post by a dielectric, and a set of inductive posts spaced apart from the central post and connecting the disc with the ground plane. The dielectric may be in the form of a support partially or completely encircling the central post. The second tuning structure comprises a printed circuit, or circuit elements formed of a conductive wire, disposed on the dielectric portion opposite a space between the conical portions of the central post.

BRIEF DESCRIPTION OF THE DRAWING

The foregoing aspects and other features of the invention are explained in the following description, taken in connection with the accompanying drawing wherein.

DETAILED DESCRIPTION

Figure 1:
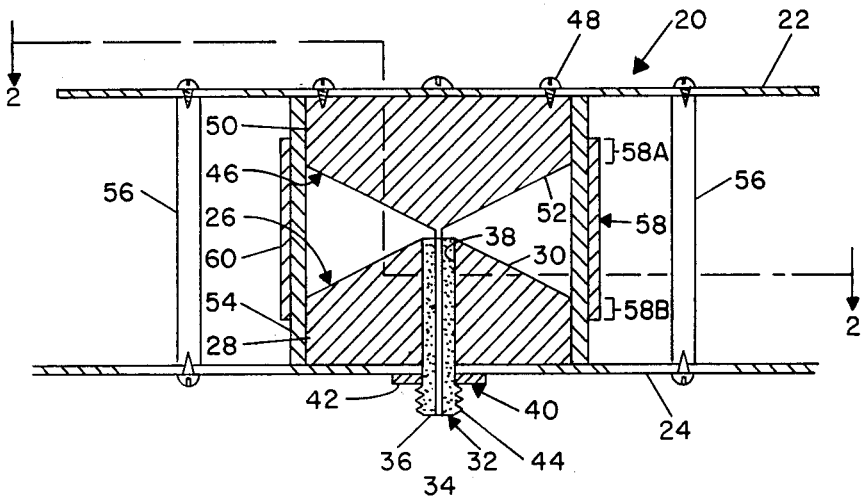
FIG. 1 is a sectional view taken along a central vertical plane of one embodiment of a monopole antenna of the invention wherein loading is accomplished by a disc, and tuning is accomplished by outboard inductive posts and a capacitive strip overlay.
Figure 2:
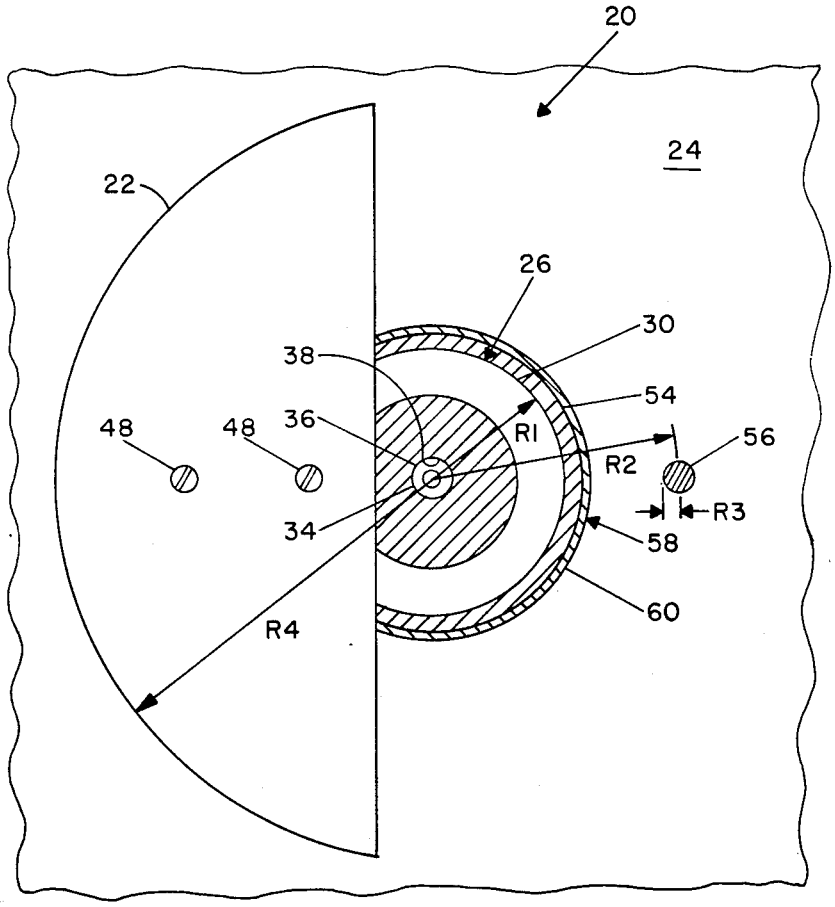
FIG. 2 is a plan view partially sectioned along line 2—2 of FIG. 1 to show an elevated feed.

FIGS. 1 and 2 show a first embodiment of the invention wherein a monopole antenna 20 is constructed with a disc 22 of electrically conducting material, such as aluminum or copper, and is mounted parallel to and spaced apart from an electrically conducting member 24 which serves as a ground plane. Typically, the size of the member 24 is larger than that of the disc 22 and, in the case of the mounting of the antenna 20 on the outer surface of a vehicle such as an aircraft (not shown), the member 24 is formed by the outer surface of the vehicle. The member 24 supports a lower portion 26 which has an outer electrically conductive surface formed as a cylinder 28 and has an upper terminus in the form of a truncated cone 30.

The lower portion 26 may be constructed in the form of a solid post, as shown in FIGS. 1 and 2, or may be formed of hollow construction (not shown). In the embodiments of FIGS. 1 and 2, the lower portion 26 is formed of a metal, such as aluminum. A coaxial transmission line 32 is disposed along a central axis of the lower portion 26 and cmprises a central conductor 34 surrounded by an insulating sleeve 36 which, in turn, is supported within a central bore 38 of the lower portion 26. The lower portion 26 serves as the outer conductor of the coaxial transmission line 32. The transmission line 32 terminates at its lower end in a connector 40 having a flange 42 which abuts the member 24, and a thread 44 by which engagement is made with a connector of a coaxial cable (not shown) for conductor of electromagnetic signals between the antenna 20 and a source and/or receiver (not shown).

An upper portion 46 is connected to central portion of the disc 22 by conventional means, such as by screws 48, and is constructed of an electrically conducting material such as aluminum. The upper portion 46 is formed with cylindrical symmetry about an axis colinear with the axis of the lower portion 26. The upper portion 46 extends over only a part of the distance between disc 22 and the ground plane member 24, the lower terminus of the upper portion 46 contacting the upper end of the central conductor 34 of the transmission line 32. The upper portion 46 has an outer surface in the form of a cylinder 50 in the upper part of the upper portion 46, and terminates in a cone 52 at the lower end of the upper portion 46. The cones 30 and 52 provide the configuration of a biconical transmission line for coupling from the lower portion 26 to the disc 22. The biconical line serves as an extension of the coaxial line 32. The upper portion 46 may also be fabricated of either hollow (not shown) or solid construction.

The spacing between the disc 22 and the member 24 may be maintained by any convenient structure such as a cylindrical dielectric support 54 which encircles the central post formed by the upper and lower portions. In addition, a pair of outer posts 56, attached by screws 48 to the disc 22 and the member 24, also function as supports as well as tuning devices as described below. In general, the central post has a diameter of approximately one-third ($\frac{1}{3}$) its height, the dimensions depending on tuning requirements. For example, in the case of an operating frequency band centered on 400 MHz, the central post may have a height of 6.7 inches and a diameter of 2.5 inches. In addition, the radius $R_1$ of the central post, the radius $R_2$ from the center to the center of post 56, the radius $R_3$ of the post 56 and the disc radius $R_4$ may be optimized.

The posts 56 are fabricated of electrically conducting material, such as aluminum, and are spaced apart from the uppe portion 26 and the truncated post 46 to provide the function of shunt inductors.

A capacitor 58 is formed by a metallic strip 60 shown as an overlay about the dielectric support 54, the upper and lower edge portions of the strip 60 overlapping a portion of each of the cylindrical surfaces 28 and 50. The region of overlap between the strip 60 and these cylindrical surfaces forms a capacitor section 58A with the support 54 serving as the dielectrical layer between the cylindrical surface 50 and the strip 60. The region of overlap between the lower edge of the strip 60 and the cylindrical surface 28 forms a capacitor section 58B with the support 54 serving as the dielectric layer between the strip 60 and the cylindrical surface 28. The central portion of the strip 60 serves as a electrical conductor for series interconnection of the capacitor sections 58A and 58B, the series combination of the capacitor sections 58A and 58B providing the capacitance of the capacitor 58.

With respect to a tuning of the antenna 20, the elevated structure of the lower portion 26 may be treated as a projection of the ground plane established by the member 24. The upper portion 46 serves as a series inductor to currents flowing between the lower portion 26 and the disc 22. The capacitor 58 provides a shunt path for current flow between the plate 22 and the member 24. From the outer end of the biconical arrangement of the surfaces of the cones 26 and 46, the series inductance of the central post 46, and the shunt inductances of the outer posts 56 act as a transformer to the antenna impedance as presented to the biconical line. Thereby, the impedance presented by the combination of the foregoing capacitance and inductance in combination with the radiation resistance is modified by the impedance transformation ratio associated with the foregoing transformer. This enables the wideband matching of the antenna 20.

Figure 3:
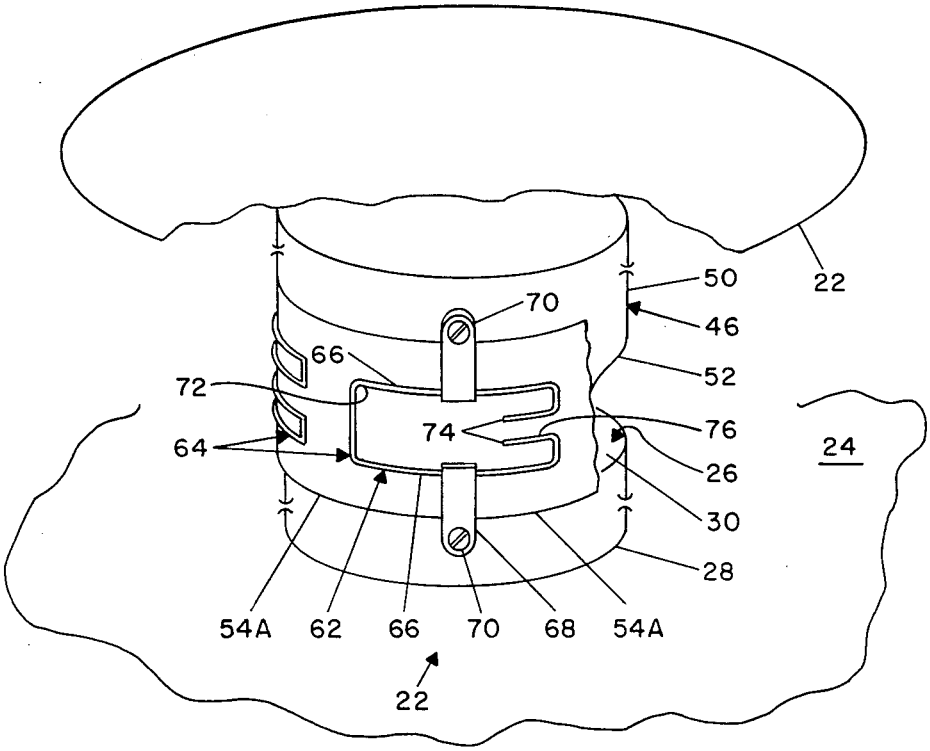
FIG. 3 is a perspective view of a modification of the embodiment of FIG. 1 with tuning accomplished by a strip conductor circuit.

FIG. 3 shows an antenna 20A which is a modified embodiment of the antenna 20 of FIGS. 1 and 2. The antenna 20A comprises the disc 22, and ground plane member 24, the elevated feed 26, and the central truncated post 46 previously described with reference to FIGS. 1 and 2. The previously described outboard inductive posts 56 and the capacitor 58 of FIGS. 1 and 2 have been replaced in FIG. 3 by a printed circuit 62 mounted on a dielectric support 54A which, in turn, is secured at its upper and lower edges by conventional means, such as by an adhesive, to the cylindrical surfaces 50 and 28 of the center post 56 and the elevated feed 26. The printed circuit 62 may be formed by conventional photolithographic technology wherein strip conductors are laminated to a substrate or, alternatively, as depicted in FIG. 3, may be fabricated of a set of wire segments 64 positioned uniformly around the support 54A. Each wire segment 64 is bent to form parallel branches 66, with each branch 66 being held by a metal clamp 68 in electrical contact with the corresponding branch 66. Metallic screws 70 are employed in securing the clamps 68 of the upper branches 66 to the central post 46, and the clamps 68 of the lower branches 66 to the feed 26. Thereby, each clamp 68 provides an electrical connection between the corresponding upper branch 66 to the cylindrical surface 50 of the post 46, and an electrical connection of the corresponding lower branch 66 to the cylindrical surface 28 of the feed 26.

In the embodiment of FIG. 3, four of the wire segments 64 are positioned on the dielectric support 54A. The support 54A is shown partially cut away to disclose the cones 30 and 52 of the feed 26 and the posts 46, respectively. Thus, FIG. 3 shows only one of the wire segments 64 in full view while a second of the wire segments 64 is only partially shown. The configuration of the wire segment 64 is sufficiently small, with respect to its extent along the central axis of the antenna 20A, so as to be positioned opposite the space between the cones 30 and 52. Therefore, there is essentially no capacitive interaction between the upper branch 66 and the cylindrical surface 50, or between the lower branch 66 and the cylindrical surface 28.

With reference to the wire segment 64 fully shown within FIG. 3, the portion of the segment 64 to the left of the clamps 68 defines an inductor 72 comprising a loop of wire. To the right of the clamps 68, the wire segment 64 terminates in two parallel end portions 74 which define a capacitor 76. The inductor 72 and the capacitor 76 are connected in parallel between the cylindrical surfaces 50 and 28. The printed circuit 62 comprises four such parallel combinations of conductor and capacitor, there being one inductor 72 and one capacitor 76 for each of the four wire segments 64 located circumferentially around the support 54A. The four inductors 72 together form a single shunt inductance between the ground plane 24 and the disc 22, and the four capacitors 76 together form a shunt capacitance between the ground plane member 24 and the disc 22. The central post 46 introduces a series inductance to these currents of the antenna embodiment of FIGS. 1 and 2.

Figure 4:
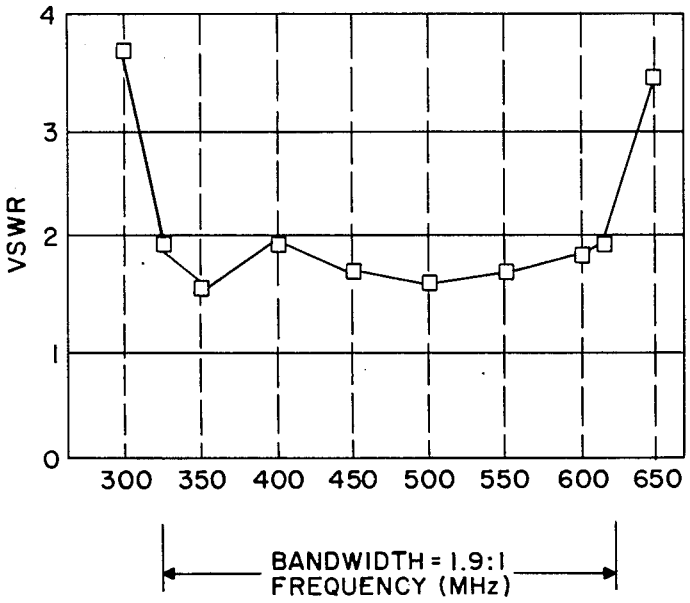
FIG. 4 is a graph illustrating the VSWR versus frequency response of a disc-loaded monopole according to the invention.
Figure 5:
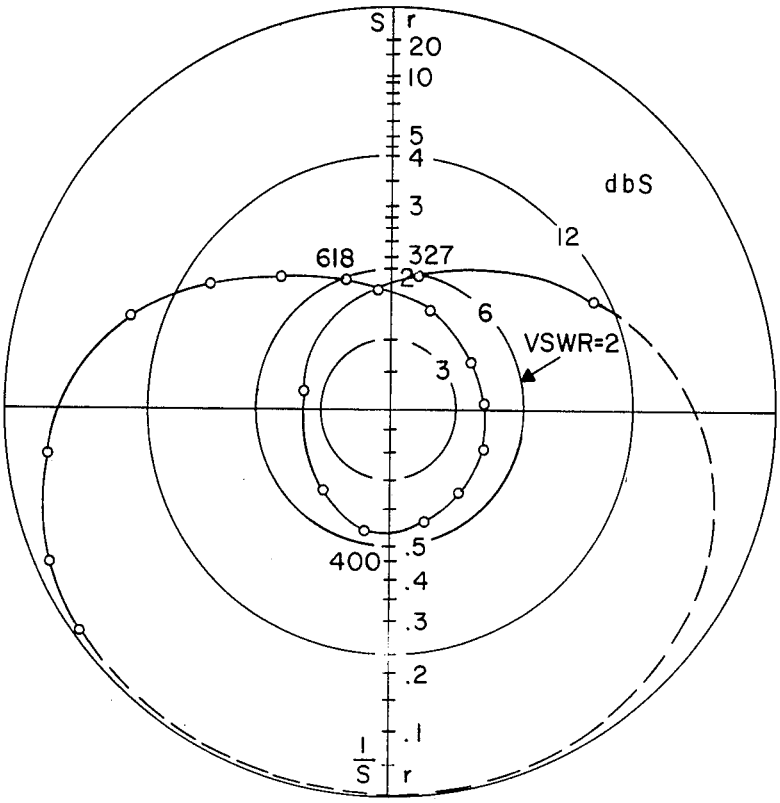
FIGS. 5 and 6 are graphs illustrating the measured input impedance of a disc-loaded monopole according to the invention tuned for a 2:1 and a 3:1 frequency band, respectively.
Figure 6:
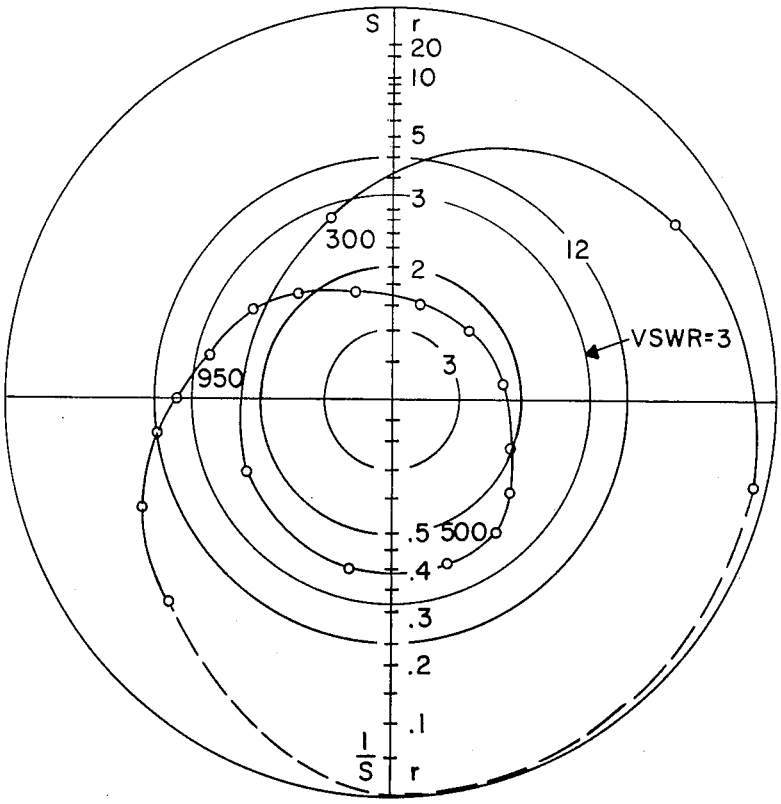

The antenna according to the invention achieves a bandwidth which is greater than that achievable by a simple monopole of the same overall dimensions in wavelength. The results are illustrated in FIG. 4 as a plot of VSWR vs. frequency. FIG. 4 illustrates results based on measurements of the actual antenna model. The graph of the actual measured impedance of the disc-loaded monopole is shown in FIGS. 5 and 6. These charts have been prepared in accordance with H. A. Wheeler's September, 1984 article titled "Reflection Charts Relating To Impedance Matching," IEEE Transactions Vol. MT-32, pp. 1008–1021. Note that the impedance plot forms two turns around the chart, which may be interpreted as implying that the disc-loaded monopole is double tuned and as suggesting that even greater bandwidth may be achieved by triple tuning. As noted above, radii $R_1$, $R_2$ and $R_3$ (in relation to the radius $R_4$ of disc 22) may be proportioned to yield a 2:1 frequency bandwidth ratio as shown in FIG. 5 or a 3:1 frequency bandwidth ratio as shown in FIG. 6. In particular, the antenna may be designed according to the following interpolation procedure: multiple models having different radii values are constructed. One model is taken as a reference from which each radius has one modified value in one of the other models. The models are then measured at identified frequencies and a set of radii is interpolated from the measured values.

Figure 7:
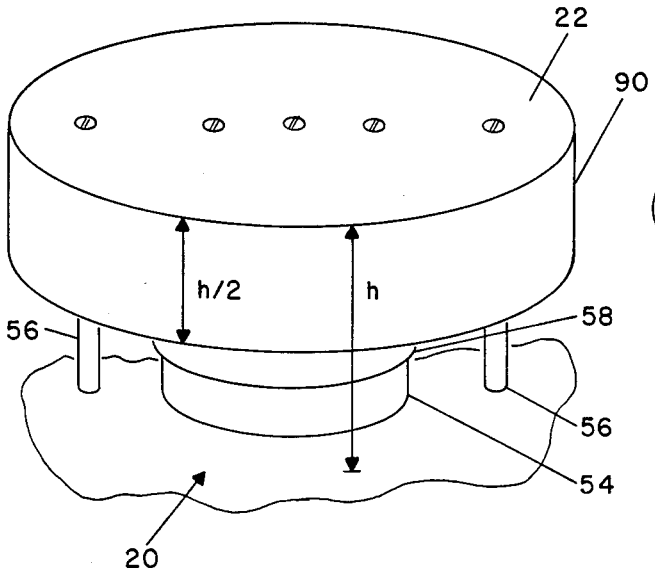
FIG. 7 is an oblique projection view of modifications of the embodiment of FIG. 1 wherein skirts are included with the disc to increase the effective volume of the antenna according to the invention and decrease its diameter.
Figure 8:
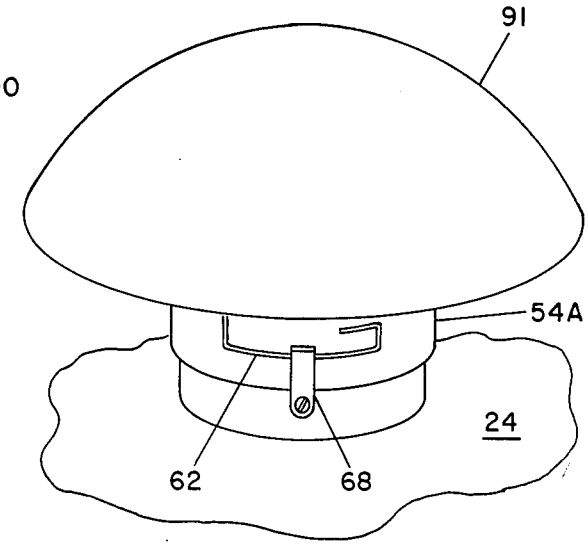
FIG. 8 is an oblique projection view of the modification of the embodiment of FIG. 3, respectively, wherein the disc is replaced by a partial sphere.

To increase the effective radius of the disc-loaded monopole and to decrease its required diameter, a skirt 90 as shown in FIG. 7 may be added to the structures illustrated in FIGS. 1 and 3. In particular, skirt 90 may be in the form of a metallic strip attached to the edge of disc 22 and extending around and downward along its full periphery. Alternatively, skirt 90 and disc 22 may be replaced by a metallic spherical cap 91 as shown in FIG. 8. The skirt 90 or dome 91 may have a height of up to half the height of the antenna 20.

Figure 9:
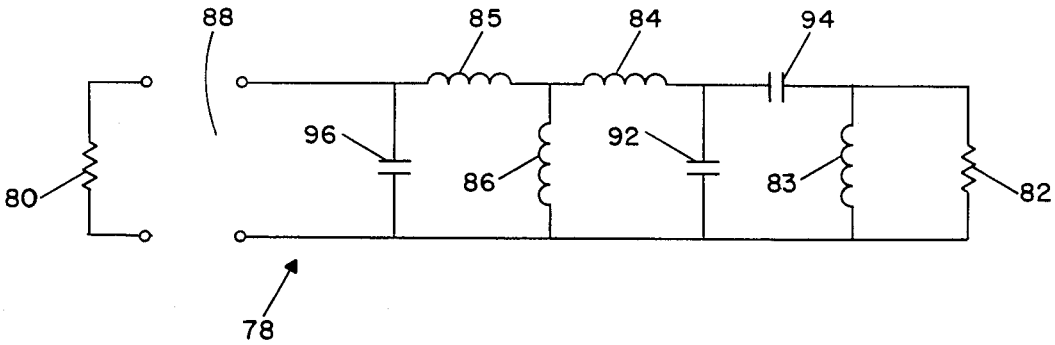
FIG. 9 shows a typical equivalent circuit of the antenna of the invention useful in tuning the various embodiments of the invention.

FIG. 9 shows a conceptual equivalent circuit based on FIG. 1 and applicable in general terms also to FIG. 3. It represents the tuning of the antenna 20 for wide-band matching, which is one objective of the invention. A resistor 80 at the line terminals 88 of the antenna circuit 78 represents the impedance of the associated transmitter or receiver circuit as seen through a line of indeterminate length. A resistor 82 at the opposite end represents the radiation of power from the antenna. From the circuit viewpoint, capacitors 92 and 94 represent the shunt and series capacitance associated with the space under the disc 22 and just outside, while the inductor 83 represents the magnetic energy associated with the transition to readiation. The total capacitance 92, 94 is tuned by the inductor 84, 86 to a frequency near midband. For double tuning, the inductor 85, 86 is tuned with capacitor 96, likewise at a frequency near midband. The inductor 86 provides the coupling required for double tuning. The composite inductor 84, 85, 86 is proportioned to provide also an impedance transformation between the two resistors 80, 82 as required for impedance matching.

The elements in the equivalent circuit can be identified with the structural features in FIG. 1. Series capacitor 94 represents the external capacitance between the disc 22 and the radiation space represented by inductor 83 and resistor 82. Shunt capacitor 92 represents the capacitance in the space under the disc 22. The composite inductor 84, 85, 86 represents, in general terms, the shunt inductance of the posts 56 and the series inductance in the space around the center post 28, 50. It is well known that a composite inductor such as 84, 85, 86 can provide shunt and series inductance and an impedance transformer ratio. The shunt capacitor 96 represents the shunt capacitance provided by the sleeve 58 and the dielectric 54 directly across the terminals of the conical line extension 26, 46. The identification of the equivalent circuit with the structural features can be achieved by computing or measuring the frequency dependence of impedance 88.

A similar correlation between FIG. 3 and a modification of FIG. 9 could be described but the concepts would remain the same. In particular, it is noted that, in view of the transformer effect produced by the biconical structure of the cones 30 and 52, the effective inductance and capacitance is enhanced to permit tuning of the antennas 20 and 20A over a broad frequency band while maintaining increased effective height between the ground plane member 24 and the disc 22, as well as maintaining a relatively low value of standing wave ratio.

By way of example in design of the antennas 20 and 20A, a bandwidth of 3:1 and SWR of 3:1, or a bandwidth of 2:1 and SWR of 2:1 represent approximate values of attainable performance characteristics. For example, a bandwidth may range from 300–600 MHz (megahertz), or 300–900 MHz. By way of example in a lower frequency antenna, a model of the antenna 20 (FIGS. 1 and 2) transmitting over a bandwidth of 30–88 MHz has a height of two feet and a diameter of six feet.

By virtue of the foregoing description, there is provided a monopole antenna which is convenient to manufacture, and which includes readily fabricated tuning elements for selection of an operating frequency band. In addition, a biconical configuration of feed and central post provides the effect of a transformer which transforms both load and tuning impedance for increased frequency bandwidth and reduced standing wave ratio, while maintaining an enlarged effective height of the antenna for more efficient transmission and reception of radiant energy.

It is to be understood that the above described embodiments of the invention are illustrative only, and that modifications thereof may occur to those skilled in the art. Accordingly, this invention is not to be regarded as limited to the embodiments disclosed herein, but is to limited only as defined by the appended claims.

What is claimed is:

1. A disc loaded monopole antenna comprising:

ground means for establishing a ground plane;

a disc of conductive material spaced apart from said ground means and parallel thereto;

tuning means disposed between said disc and said ground means for tuning said antenna, said tuning means including a central conductive post with an upper portion connected to the disc and a lower portion coaxial with the upper portion and connected to the ground means, said portions defining a radially tapered opening therebetween;

said tuning means further including non-central conductive posts interconnecting the disc and the ground means;

a coaxial transmission line inside said lower portion having an outer conductor in contact with said lower portion and an inner conductor in contact with the upper portion; and means for supporting said disc parallel to said ground means.

2. An antenna according to claim 1 wherein said ground means is a flat plate of conducting material.

3. An antenna according to claim 1 wherein the radially tapered opening between the upper and lower portions of said central post is in the form of a biconical transition.

4. An antenna according to claim 1 wherein said tuning means is separated from said upper and lower portions by a dielectric overlapping the upper and lower portions of said central post.

5. An antenna according to claim 1 wherein said non-central posts comprise a pair of solid, inductive posts spaced apart and outward from said central post and electrically connecting said disc with said ground plane.

6. An antenna according to claim 5 wherein said means for supporting comprises a dielectric support encircling the central post and wherein said tuning means further comprises a conductive sheet encircling said dielectric support and overlapping the upper and lower portions of said central post providing shunt capacitance and said central post providing series inductance to an electric current flowing via said coaxial transmission line.

7. An antenna according to claim 1 wherein said tuning means further comprises a printed circuit disposed on said dielectric support and encircling said dielectric support, said printed circuit being positioned opposite the radially tapered opening between said portions of said central post, said portions having outer cylindrical surfaces positioned away from said printed circuit.

8. An antenna according to claim 7 wherein said printed circuit comprises a plurality of individual circuits positioned about said central post.

9. An antenna according to claim 8 wherein said dielectric support extends partway along said cylindrical surface exposing portions of said cylindrical surfaces, said antenna further comprising clamps electrically connecting portions of said individual circuits to the exposed portions of said cylindrical surfaces of said upper and lower portions of said central post.

10. An antenna according to claim 9 wherein each of said individual circuits of said tuning means comprises a strip electrical conductor bent to form parallel branches connected at one end by a bent-wire inductor.

11. An antenna according to claim 9 wherein each of said individual circuits of said tuning means comprises a strip electrical conductor bent to form parallel branches defining a bent-wire capacitor.

12. An antenna according to claim 11 wherein said parallel branches are connected at one end in a partial loop inductor.

13. An antenna according to claim 12 wherein said partial loop inductor provides an inductance and said capacitor plates provide a capacitance in parallel with said inductance.

14. An antenna according to claim 12 wherein said bent-wire inductor provides shunt inductance between said disc and said ground plane, and wherein said bent-wire capacitor provides shunt capacitance between said disc and said ground plane.

15. An antenna according to claim 1 wherein said central post has a width which is at least one-tenth of the height of said central post.

* * * * *